US007901035B2

(12) United States Patent
Koehler et al.

(10) Patent No.: US 7,901,035 B2
(45) Date of Patent: Mar. 8, 2011

(54) DIRECTED FLOW DRIP BIB FOR PRINTHEAD WITH THREE POINT CONTACT

(75) Inventors: David Roland Koehler, Sherwood, OR (US); Edward Charles Grenier, Portland, OR (US); Gerard Rousseau, Portland, OR (US); Garry Adam Jones, Sherwood, OR (US); Michael Edward Norkitis, Newberg, OR (US); James Matthew Cunnington, Tualatin, OR (US); Hattie Raeann Hiatt, Buhl, ID (US)

(73) Assignee: Xerox Corporation, Norwalk, CT (US)

( * ) Notice: Subject to any disclaimer, the term of this patent is extended or adjusted under 35 U.S.C. 154(b) by 199 days.

(21) Appl. No.: 12/394,368

(22) Filed: Feb. 27, 2009

(65) Prior Publication Data

US 2010/0220145 A1 Sep. 2, 2010

(51) Int. Cl.
*B41J 2/165* (2006.01)

(52) U.S. Cl. ..... 347/36; 347/35

(58) Field of Classification Search ..... 347/36, 347/20, 41, 43, 35
See application file for complete search history.

(56) References Cited

U.S. PATENT DOCUMENTS

2007/0076048 A1 4/2007 Cunnington et al.
2007/0126783 A1 6/2007 Deshon-Stepp et al.

*Primary Examiner* — Shih-Wen Hsieh

(74) *Attorney, Agent, or Firm* — Maginot, Moore & Beck LLP

(57) ABSTRACT

A drip bib for use with a printhead of an imaging device includes a plate having an upper surface having an upper edge, an intermediate surface angled with respect to the upper surface, and a lower edge. The intermediate surface includes a plurality of fastener openings. The lower edge includes a drip point projecting from the lower edge with remaining portions of the lower edge being upturned and angled downwardly from at least one end of the lower edge toward the drip point. A plurality of protrusions protrudes from a back side of the upper surface. The protrusions in the plurality of protrusions are spaced from each other and proximate the upper edge.

20 Claims, 4 Drawing Sheets

DIRECTED FLOW DRIP BIB FOR PRINTHEAD WITH THREE POINT CONTACT

TECHNICAL FIELD

This disclosure relates generally to phase change ink jet imaging devices, and, in particular, to the printheads used in such imaging devices.

BACKGROUND

In general, ink jet printing machines or printers include at least one printhead that ejects drops or jets of liquid ink onto a recording or image forming media. A phase change ink jet printer employs phase change inks that are solid at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In various modes of operation, ink may be purged from the printheads to ensure proper operation of the printhead. During purging, ink is typically forced through the ink pathways, chambers, and out the ink jets of the printhead to help remove contaminants, such as air bubbles, dried ink, and debris from in and around the ink jets. The purged ink flows down and off the face of the printhead typically to a waste tray positioned below the printhead. Absent any additional structure, the ink can flow freely along the bottom edge of the printhead and drip from the printhead anywhere along that bottom edge. To help control this dripping flow of waste ink, a drip bib may be added near the bottom edge of the printhead.

Previously known drip bibs were formed by generally flat plates that were secured to printheads by fasteners, such as screws or bolts. When secured to the printhead, the upper edge of these previously known drip bibs were generally in contact with the printhead adjacent the lower edge of the ejecting face along the entire drip bib upper edge. Because the previously known drip bibs were secured to the printhead with a plurality of screws, the majority of the clamping force of the fasteners against the drip bib is exerted along the contact edge of the drip bibs in the areas that are closest to the screws with lesser force being applied to the contact edge as the distance from the fasteners along the contact edge increases. This variation in clamping force can cause deformation or distortion of the drip bib, and, consequently, a corresponding distortion of the printhead. Distortion or deformation of a printhead may cause some areas of the printhead to be closer or farther away from the imaging member than others during printing which, in turn, may adversely impact the print quality of images formed by the printhead.

SUMMARY

In order to alleviate the problems associated with uneven contact pressure across the contact edge of a drip bib, a drip bib has been developed that includes load points spaced across the contact edge to distribute the clamping force of the fasteners more evenly across the contact edge. In particular, a drip bib for use with a printhead of an imaging device includes a plate having an angled upper surface, a flat intermediate surface, and a lower edge. The intermediate surface includes a plurality of fastener openings. The lower edge includes a drip point projecting from the lower edge with remaining portions of the lower edge being upturned and angled downwardly from at least one end of the lower edge toward the drip point. The angled upper surface is angled in a first direction with respect to the intermediate portion and includes an upper edge. A plurality of protrusions protrudes from the angled upper surface in the first direction. The protrusions in the plurality of protrusions are spaced from each other and proximate the upper edge.

In another embodiment, a printhead assembly for use in an imaging device includes a printhead having an ejecting face. The printhead is configured to receive liquid ink from an ink source and to eject ink through the ejecting face onto an ink receiving surface. A drip bib is attached to the printhead by a plurality of fasteners. The drip bib has an outer surface that faces away from the printhead and an inner surface that faces toward the printhead. The drip bib includes a lower portion having a lower edge. The lower portion includes a drip point extending below the lower edge. The remaining portions of the lower edge are upturned and angled downwardly from at least one end of the lower edge toward the drip point. A substantially flat intermediate portion is positioned above the lower portion that includes a plurality of fastener openings through which the plurality of fasteners is inserted into the printhead. An upper edge is positioned above the intermediate portion and adjacent a lower edge of the ejecting face that includes a plurality of protrusions that protrude from the inner surface of the drip bib proximate the upper edge.

In yet another embodiment, an imaging device is provided that includes a first upper printhead and a second upper printhead laterally positioned across a width of an image receiving surface and having a first gap therebetween, the first and the second upper printheads each having an ejecting face through which ink is ejected toward the image receiving surface. The imaging device also includes a first lower printhead and a second lower printhead laterally spaced across the width of the image receiving surface and having a second gap therebetween, the first and the second upper printheads each having an ejecting face through which ink is ejected toward the image receiving surface. The first and the second lower printheads are positioned below the first and the second upper printheads and laterally offset from the upper printheads so that the first upper printhead overlaps a portion of both the first and the second lower printheads and the second upper printhead overlaps a portion of the second lower printhead extending laterally beyond the second lower printhead. A drip bib is attached to each of the first and second upper and lower printheads adjacent a lower edge of respective ejecting faces of the printheads. Each drip bib has a lower edge with a drip point that extends below the lower edge with remaining portions of the lower edge being upturned and angled downwardly from at least one end of the lower edge toward the drip point, the drip point of the first upper printhead being positioned along the lower edge above the second gap between the first and the second lower printheads.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
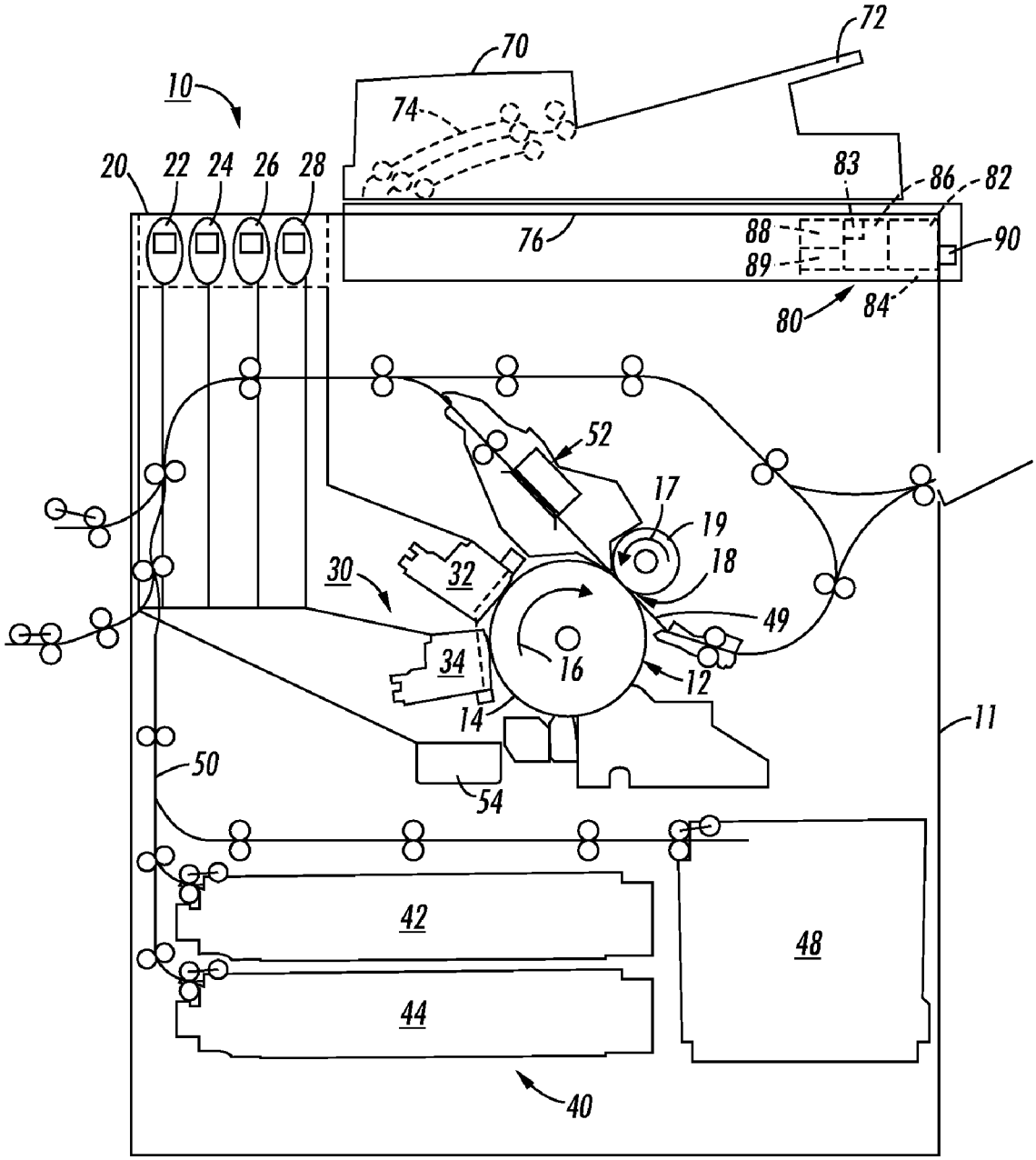
FIG. 1 is a schematic diagram of an embodiment of an ink jet printing apparatus.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Referring now to FIG. 1, an embodiment of an image producing machine, such as a high-speed phase change ink image producing machine or printer 10 of the present disclosure, is depicted. As illustrated, the machine 10 includes a frame 11 to which are mounted directly or indirectly all its operating subsystems and components, as described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed. A heated transfix roller 19 rotatable in the direction 17 is loaded against the surface 14 of drum 12 to form a transfix nip 18, within which ink images formed on the surface 14 are transfixed onto a heated copy sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for then supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g. four (4)) of separate printhead assemblies 32, 34, 36 and 38 as shown.

As further shown, the phase change ink image producing machine or printer 10 includes a substrate supply and handling system 40. The substrate supply and handling system 40, for example, may include sheet or substrate supply sources 42, 44, 46, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the printhead cleaning apparatus and method discussed below.

In operation, image data for an image to be produced are sent to the controller 80 from either the scanning system 76 or via the online or work station connection 90 for processing and output to the printhead assemblies 32, 34, 36, 38. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 46, 48 and handled by means 50 in timed registration with image formation on the surface 14. Finally, the image is transferred from the surface 14 and fixedly fused to the copy sheet within the transfix nip 18.

Figure 2:
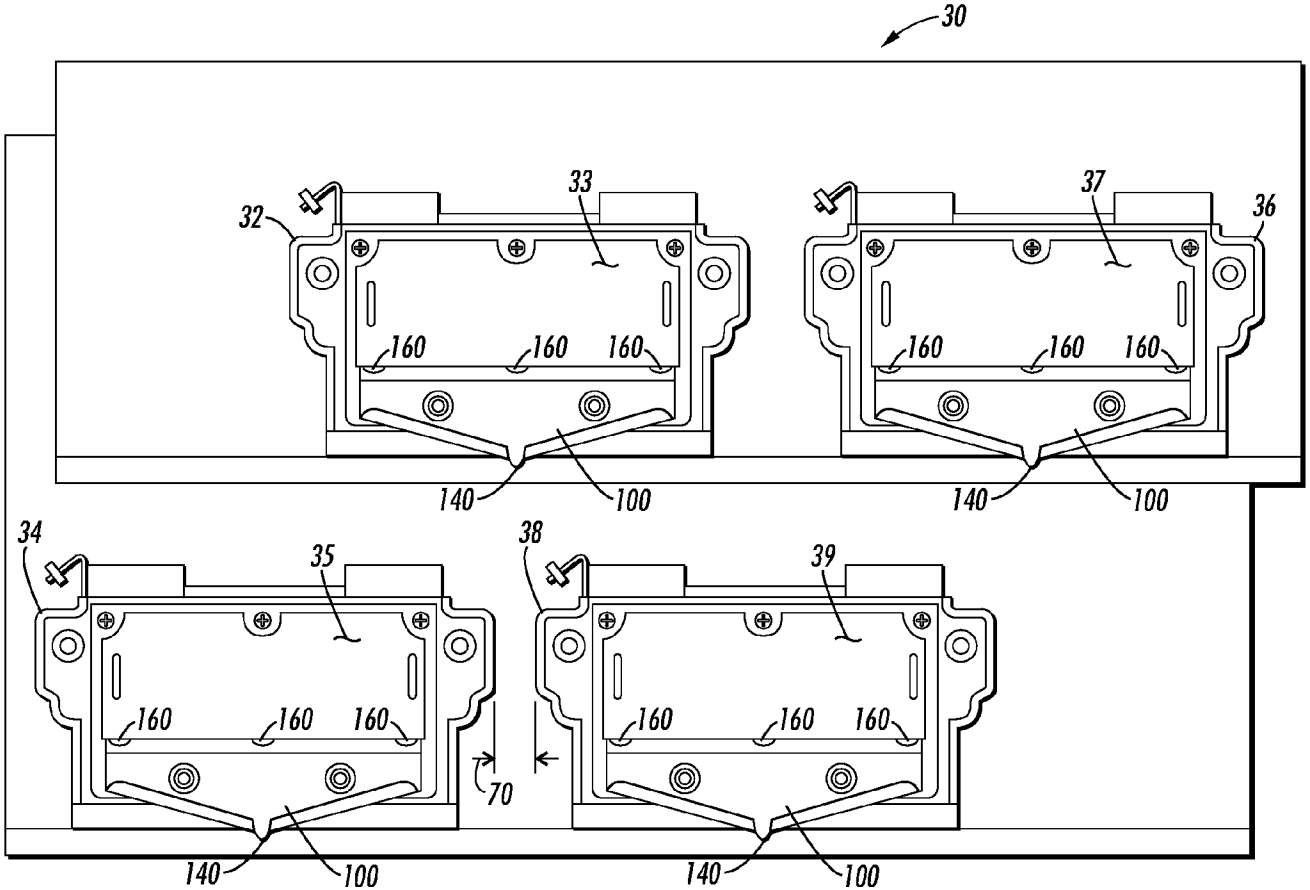
FIG. 2 is front elevational view of the printhead system of the imaging device of FIG. 1.

Referring now to FIG. 2, the printer/copier 10 described in this example is a high-speed, or high throughput, multicolor image producing machine, having four printheads, including upper printheads 32 and 36, and lower printheads 34 and 38. Each printhead 32, 34, 36 and 38 has a corresponding front face 33, 35, 37 and 39 for ejecting ink onto the receiving surface 14 to form an image. While forming an image, a mode referred to herein as print mode, the upper printheads 32, 36 may be staggered with respect to the lower printheads 34, 38 in a direction transverse to the receiving surface path 16 (FIG. 1) in order to cover different portions of the receiving surface 14. The staggered arrangement enables the printheads to form an image across the full width of the substrate. In print mode the printhead front faces 33, 35, 37, 39 are disposed close to the imaging surface 14, for example about 23 mils.

In various modes of operation, ink may be purged from the printheads to ensure proper operation of the printhead. When ink is purged through the printhead, the ink flows down and off the front face of the printhead. Commonly, during a cleaning cycle, a scraper or wiper blade (not shown) may also be drawn across the ink ejecting front face of the printhead to squeegee away any excess liquid phase ink that may collect there. The waste ink wiped-off or otherwise removed from the face of the printhead is typically allowed to drop directly from a lower edge 124 (FIG. 3) of the front face of a printhead into a collection pan or waste ink container 54 (FIG. 1) where it cools and re-solidifies. When the collection pan is full, it may be removed, manually emptied and then reinstalled in the printer.

Absent any additional structure, the ink can flow freely along the bottom edge of the printhead ejecting face and drip from the printhead anywhere along that bottom edge. Due to the staggered arrangement of the upper and lower printheads, however, purged ink that flows or drips from the bottom edge of the upper printheads may splash onto the lower printheads. Ink from the upper printheads splashing onto the lower printheads may cause a variety of problems, including: color mixing in the printhead aperture plate, contamination of the drum, inhibited range of motion of the motors or pivot points that control printhead movement, and contamination of other systems within the imaging device.

Figure 3:
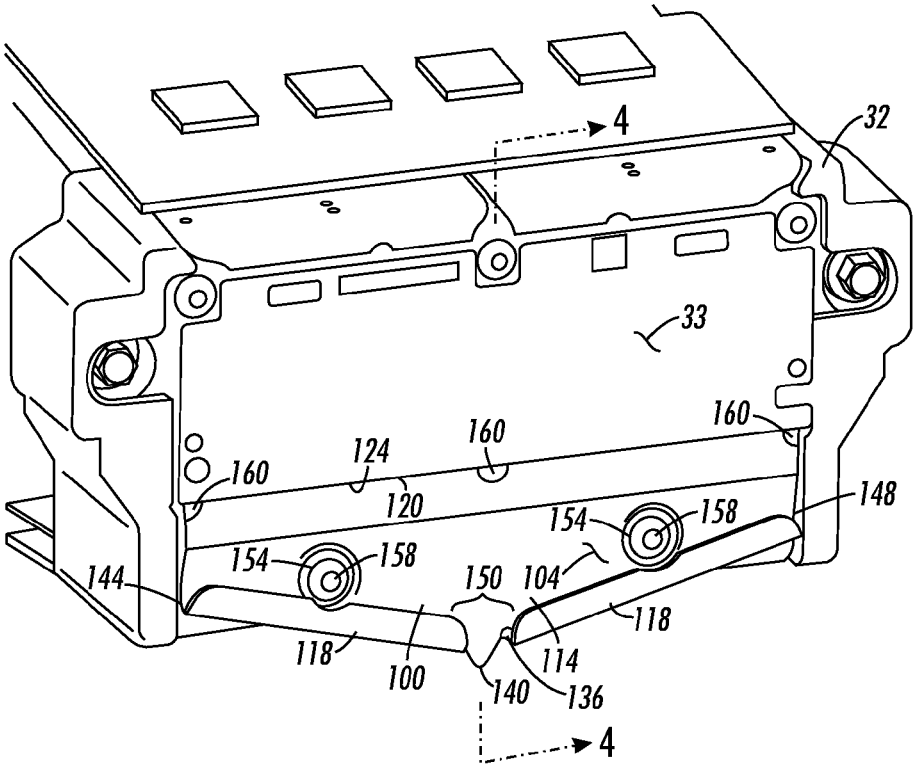
FIG. 3 is perspective view of a printhead of the printhead system showing an embodiment of a drip bib.
Figure 4:
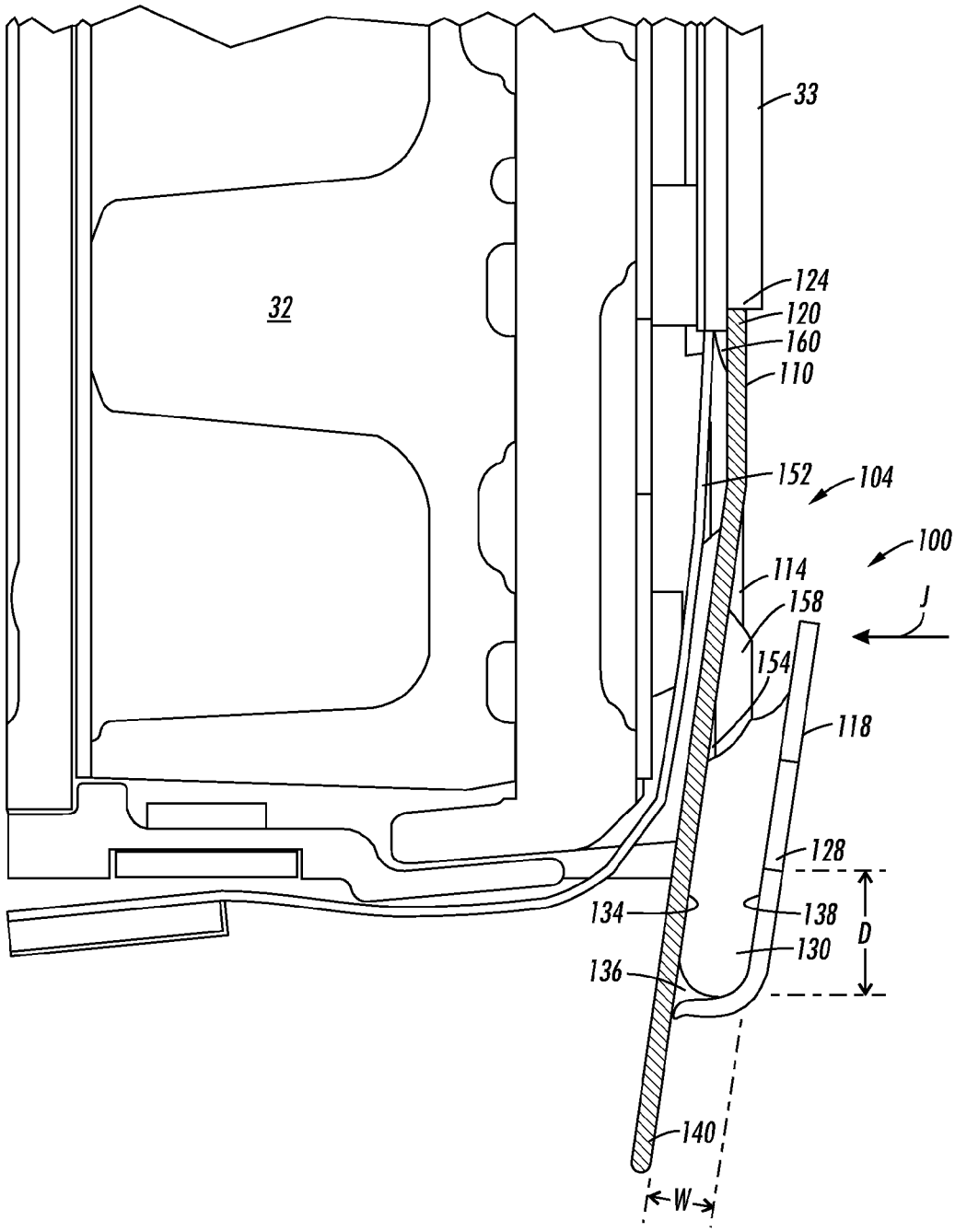
FIG. 4 is a side cross-sectional view of the drip bib of FIG. 3 taken along line 4-4.

To help control this dripping flow of waste ink from the ejecting face of the printheads, a drip bib 100 may be added near the bottom edge of the ejecting faces of the printheads as depicted in FIG. 2. FIGS. 3 and 4 show a more detailed view of an embodiment of a drip bib 100. The drip bib 100 comprises a metal plate, such as stainless steel or aluminum, having a one-piece construction that may be manufactured using conventional sheet metal forming techniques. Other suitable material or combination of materials, however, may be utilized for the drip bib plate including other metals and/or rigid plastic materials.

The drip bib plate has an outer surface 104 that faces in generally the same direction as the ejecting face 33 of the printhead and comprises the surface to which the ink flows from the ejecting face. The drip bib plate 100 includes an upper surface 110, an angled intermediate surface 114, and an upturned lower edge 118. When the drip bib 100 is secured to the jet stack (explained below), the upper surface 110 is below and generally parallel to the front face 33 of the printhead 32, as depicted in FIG. 4. The upper surface 110 of the drip bib 100 includes an upper edge 120, also referred to herein as a contact edge. The upper surface 110 of the drip bib is positioned with respect to the ejecting face 33 so that the contact edge 120 of the drip bib abuts the lower edge 124 of the ejecting face 33. The angled intermediate surface 114 is below the upper surface and angled backwardly with respect to the upper surface in a direction J toward the printhead 32, and, in particular, toward a recessed mounting surface 152. The upper surface 110 guides the waste ink from the ejecting face 33 to the intermediate surface 114 which in turn guides the flow of the ink to channels formed by the upturned lower edges 118 of the drip bib. As waste ink flows down the drip bib, the waste ink remains in contact with the angled intermediate surface 114 of the drip bib due to the surface tension characteristics of the ink relative to the drip bib outer surface.

The lower edge 118 of the drip bib is curled or upturned at one or more locations along the lower edge to form one or more channels that are open across the top to collect the ink that flows down from the ejecting face 33 of the printhead. The upturned edges 118 are curled or rounded at the bottom although they may be angled to form a V-shaped or square-shaped bottom surface. The channels defined by the upturned lower edges 118 of the bib have a depth D from the top 128 of the upturned edge 118 to the bottom surface 130 of the channel and a width W from the inner surface 134 of the upturned edge 118 to the outer surface 138 of the upper edge. The depth D and the width W of the channels may be suitably sized to enable the channels 118 to have enough capacity to prevent ink that flows down from the ejecting face 33 from overflowing and escaping the channels prior to the ink reaching the drip point 140 on the lower edge. The upturned edges 118 that form the channels of the drip bib begin at one or both ends 144, 148 of the drip bib lower edge and are angled downwardly from the end(s) 144, 148 to force the flow of ink to a protruding tip 140, referred to herein as a drip point, that channels the waste ink flow in a controlled and timely manner.

The drip point 140 is positioned along the lower edge at a gap 150 between the channels 118 formed by the upturned lower edges of the drip bib. The drip point 140 comprises a projection or extension that extends below the lower edge 118 and the channel(s) formed by the lower edge of the lower portion of the drip bib. The protruding tip of the drip point 140 concentrates the flow of ink from the channels, and allows the ink to collect at the tip and form a critical mass for drop formation and release which may be beneficial especially near the end of a purge cycle when the waste ink flow slows and eventually stops. The drip point may be any suitable configuration that enables ink to drip or flow in a controlled manner from the drip point. In the embodiment of FIGS. 2-4, the drip point 140 has a narrow, tapered shape with a rounded end. The drip point, however, may have any suitable shape including pointed or flat ends and straight, angled, or rounded edges. In addition, the drip point 140 is positioned at a predetermined location along the lower edge of the drip bib to enable the flow of waste ink to be directed in a manner that avoids, for example, splashing ink onto other printheads or systems within the imaging device. The drip point may be at any suitable location along the lower edge of the drip bib. For example, depending on printhead placement, waste ink tray position, and available space within the imaging device, the drip point may be positioned at any point along the lower edge from end to end. In alternative embodiments, more than one drip point may be utilized.

In the embodiment of FIGS. 2-4, the drip point is positioned at an intermediate location along the lower edge 118. The gutters 118 formed by the upturned portions of the lower edge 118 are angled downwardly toward the drip point 140 to form the channels that channel ink toward the drip point 140. As depicted in FIGS. 3 and 4, gutter-to-drip point transition surfaces 136 are included in the drip bib to control the flow of ink from the gutters to the drip point. The transition surfaces comprise angled surfaces that extend between the bottom surface of the gutters and the drip point. Transition surfaces may be formed in any suitable manner. For example, in one embodiment, transition surfaces may be formed integrally with drip bib by, for example, stretching or deforming the material that connects the lower edges 118 that form the gutters to the drip point 140 during the gutter formation process.

The drip point position, at least on the drip bibs of the upper printheads 32, 36, enables the waste ink generated by the upper printheads 32, 36 to be directed through gaps between the lower printheads. For example, referring to FIG. 2, upper printhead 32 is positioned above the two lower printheads 34 and 38 such that the drip point 140 of the drip bib 100 of printhead 32 is located directly above a lateral gap 70 between the two lower printheads 34 and 38. The waste ink from the printhead 32 is then directed in a stream from the drip point 140 of printhead 32 between the two lower printheads 34 and 38 into waste tray (not shown) so the waste ink does not drip or splash onto the lower printheads 34,38.

To secure the drip bib 100 to the printhead jet stack, the drip bib includes fastener openings (not shown) that extend through the intermediate portion 114 of the drip bib and align with fastener openings (not shown) in the lower portion of the printhead jet stack when the drip bib 100 is properly placed on the jet stack. The drip bib 100 may be secured to the jet stack using fasteners 158, such as threaded screws or through-bolts, which are inserted through the fastener openings in the drip bib and threaded into or otherwise secured to the fastener openings in the jet stack. In the embodiment of FIGS. 2-4, two fasteners 158 are used to secure the drip bib 100 to the jet stack although, in other embodiments, more or fewer (i.e., one) fasteners may be utilized. In the embodiment of FIGS. 2-4, the fastener openings are formed in recessed features 154 in the intermediate surface 114 that enable the fasteners to be inserted through the openings and received in the fastener holes in the jetstack in a direction (J) perpendicular to the front face 33 and upper surface 110 of the drip bib 100.

As mentioned above, one issue faced in securing the drip bib to the printhead using fasteners is uneven contact pressure between the upper edge of the drip bib and the lower edge of the ejecting face caused by the clamping force of the fasteners which may cause a corresponding distortion or deformation of the printhead ejecting face. Accordingly, in order to prevent uneven contact pressure between the upper edge 120 of the drip bib and the lower edge 124 of the ejecting face, the upper edge 120 of the drip bib has been modified to include load points 160. In the embodiment of FIGS. 2-4, the load points 160 comprise dimples or similar protruding structures that are located in the upper surface 110 of the drip bib adjacent or proximate the upper edge 120 and that protrude from the inner surface of the upper surface 110 of the drip bib in the direction J toward the printhead 32. As used herein, the term dimple(s) refers to a protrusion that may be formed by pressing or stamping one side of the plate to cause plate material to protrude from the opposite side of the plate. Dimples may be formed using conventional sheet metal processing techniques. As an alternative to using dimples to form the load points, material may be added to drip bib to serve as the load points. For example, the load points may be formed by adding material, such as metal, rigid plastics or ceramics, to the upper portion of the drip bib at appropriate locations along the upper edge 120.

When the drip bib is secured to the printhead by the fasteners 158, the load points 160 are configured to control the contact between the upper edge 120 of the drip bib and the ejecting face for a uniform distribution of the clamping load of the fasteners 158 along the upper edge 120 of the drip bib. The load points 160 of the drip bib thus enable the drip bib to be secured to the printhead using fasteners without the clamping load of the fasteners deforming the drip bib 100 and/or ejecting face 33. In the embodiment of FIGS. 2-4, three load points 160 are utilized in the drip bib 100 thereby spreading the clamping load of the fasteners onto three separate points proximate the upper edge 120 of the drip bib. The load points are substantially evenly distributed or spaced along the upper edge with a load point being positioned adjacent each end of the upper edge, and a load point in a central location along the upper edge that is between the two fasteners. Any suitable number and positioning of load points, however, may be utilized.

While the drip bib apparatus described above has been discussed with reference to a phase change ink printing device, it may be used with other imaging devices to control the flow of waste ink therein. It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A drip bib for use with a printhead of an imaging device, the drip bib comprising:

a plate having an upper surface, an intermediate surface angled with respect to the upper surface, and a lower edge, the upper surface including an upper edge, the angled intermediate surface including a plurality of fastener openings, the lower edge including a drip point projecting below the lower edge, remaining portions of the lower edge being upturned and angled downwardly from at least one end of the lower edge toward the drip point; and a plurality of protrusions that protrude from a back side of the upper surface, the plurality of protrusions each being spaced from each other proximate the upper edge.

2. The drip bib of claim 1, each protrusion in the plurality comprising a dimple formed in the upper surface.

3. The drip bib of claim 2, the plurality of fastener openings in the angled intermediate surface including two fastener openings that are laterally spaced from each other in the angled intermediate surface.

4. The drip bib of claim 3, the plurality of protrusions comprising three protrusions including a first protrusion positioned proximate a first end of the upper edge, a second protrusion proximate a second end of the upper edge, and a third protrusion positioned along the upper edge between the two fastener openings.

5. The drip bib of claim 4, the fastener openings being countersunk in a first direction.

6. The drip bib of claim 1, the plate being formed of stainless steel.

7. A printhead assembly for use in an imaging device, the printhead assembly including:

a printhead having an ejecting face, the printhead being configured to receive liquid ink from an ink source and to eject ink through the ejecting face onto an ink receiving surface; and a drip bib attached to the printhead by a plurality of fasteners, the drip bib having an outer surface that faces away from the printhead and an inner surface that faces toward the printhead, the drip bib including:

a lower edge having a drip point that extends below the lower edge, remaining portions of the lower edge being upturned and angled downwardly from at least one end of the lower edge toward the drip point;

an intermediate surface positioned above the lower edge and including a plurality of fastener openings for receiving the plurality of fasteners;

an upper edge positioned above the intermediate surface and adjacent a lower edge of the ejecting face; and a plurality of protrusions that protrude from the inner surface of the drip bib, the plurality of protrusions being spaced from each other proximate the upper edge.

8. The printhead of claim 7, the drip bib comprising a plate.

9. The printhead of claim 8, the plate being formed of stainless steel.

10. The printhead of claim 7, each protrusion in the plurality comprising a dimple that protrudes from the inner surface of the drip bib.

11. The printhead of claim 10, the plurality of fastener openings in the intermediate surface including two fastener openings that are laterally spaced from each other in the intermediate surface.

12. The printhead of claim 11, the plurality of protrusions comprising three protrusions including a first protrusion positioned proximate a first end of the upper edge, a second protrusion proximate a second end of the upper edge, and a third protrusion positioned along the upper edge between the two fastener openings.

13. The printhead of claim 12, the fastener openings being countersunk in a direction from the outer surface toward the inner surface of the drip bib.

14. An imaging device including:

a first upper printhead and a second upper printhead laterally positioned across a width of an image receiving surface and having a first gap therebetween, the first and the second upper printheads each having an ejecting face through which ink is ejected toward the image receiving surface;

a first lower printhead and a second lower printhead laterally spaced across the width of the image receiving surface and having a second gap therebetween, the first and the second upper printheads each having an ejecting face through which ink is ejected toward the image receiving surface, the first and the second lower printheads being positioned below the first and the second upper printheads and laterally offset from the first and the second upper printheads so that the first upper printhead overlaps a portion of both the first and the second lower printheads and the second upper printhead overlaps a portion of the second lower printhead extending laterally beyond the second lower printhead;

a drip bib attached to each of the first and second upper and lower printheads adjacent a lower edge of respective ejecting faces of the printheads, each drip bib having a lower edge with a drip point that extends below the lower edge, remaining portions of the lower edge being upturned and angled downwardly from at least one end of the lower edge toward the drip point, the drip point of the first upper printhead being positioned along the lower edge above the second gap between the first and the second lower printheads.

15. The imaging device of claim 14, each drip bib including an intermediate surface positioned above the lower edge and including a plurality of fastener openings through which are inserted a plurality of fasteners that secure the drip bibs to the associated printhead.

16. The imaging device of claim 15, each drip bib including an upper edge positioned above the intermediate surface and adjacent a lower edge of the ejecting face, the upper edge including a plurality of protrusions that protrude from an inner surface of the drip bib proximate the upper edge and that contact the associated printhead adjacent the lower edge of the ejecting face.

17. The imaging device of claim 16, each protrusion in the plurality comprising a dimple that protrudes from the inner surface of the drip bib.

18. The imaging device of claim 17, the plurality of fastener openings including two fastener openings that are laterally spaced from each other in the intermediate surface.

19. The imaging device of claim 18, the plurality of protrusions comprising three protrusions including a first protrusion positioned proximate a first end of the lower edge, a second protrusion proximate a second end of the lower edge, and a third protrusion positioned along the upper edge between the two fastener openings.

20. The imaging device of claim 19, the fastener openings being countersunk in a direction from an outer surface toward the inner surface of the drip bib.

* * * * *